United States Patent [19]

Piana et al.

[11] Patent Number: 4,876,810

[45] Date of Patent: Oct. 31, 1989

[54] OPEN SLEEVE SUPPORT FOR WIRE MARKING ELEMENTS WITH SNAP LOCK

[75] Inventors: Ivana Piana; Silvano Piana, both of Genova, Italy

[73] Assignee: Graphoplast S.p.A., Italy

[21] Appl. No.: 207,284

[22] Filed: Jun. 15, 1988

[30] Foreign Application Priority Data

Jun. 19, 1987 [IT] Italy ..... 12502 A/87
Mar. 25, 1988 [IT] Italy ..... 12446 A/88

[51] Int. Cl.[4] ..... G09F 3/00
[52] U.S. Cl. ..... 40/316
[58] Field of Search ..... 40/316, 299, 317, 322, 40/558; 248/50, 60, 62, 74.2; 174/112; 24/545

[56] References Cited

U.S. PATENT DOCUMENTS 4,566,660 1/1986 Anscher et al. ..... 24/545
4,649,658 3/1987 Sarton et al. ..... 40/317

FOREIGN PATENT DOCUMENTS 121454 10/1984 European Pat. Off. .
144675 6/1985 European Pat. Off. ..... 174/112
2819923 11/1978 Fed. Rep. of Germany ..... 248/74.2
3200177 7/1983 Fed. Rep. of Germany ..... 174/112
1321537 2/1963 France .

*Primary Examiner*—Mancene Gene
*Assistant Examiner*—Cary E. Stone
*Attorney, Agent, or Firm*—Jacobs & Jacobs

[57] ABSTRACT

This open support has the configuration of a "C" shaped sleeve (1) provided along the free ends of the "C" with two opposed lateral shapes (3) connected by weakened zones (2); each shape being provided with an inwards directed upper thin triangular projection (4) and a lower convex projection (5) so that during the assembly of the support (1) on the cable (6) the sleeve (1) is subjected to elastic strain and the shapes (3) begin to oscillate around the weakened zones (2) so that, due to an elastic thrust of the shapes (3) acting on the external lower semicircumference of the cable (6), the latter is pushed inwards and will snap into the sleeve (1) causing a further oscillation of the shapes (3) until they reach their end position while pushing the cable (6) inwards by boundary pressure.

13 Claims, 2 Drawing Sheets

OPEN SLEEVE SUPPORT FOR WIRE MARKING ELEMENTS WITH SNAP LOCK

This invention covers an open sleeve support for electric cable marking provided with oscillating shapes along the open edges of the sleeve, these shapes snap around the cable. Various types of coded sleeves or bearing marking elements are known for electrical wire or cable marking, i.e. supports bearing clearly visible identification codes and these supports are either closed sleeves or open "C" shaped supports.

Closed sleeves as described in the English Patent No. 970278, U.S. Pat. No. 3,534,777 and the German Patent No. 2614700 have the serious drawback in that they have to be mounted on the cables before the latter can be connected. Moreover these sleeves are not steady on the cable because their calmping grip is insufficient. Therefore, closed sleeves are being increasinly replaced by open "C" sleeves. "C" shaped sleeves are therefore also well known. These sleeves are particularly important for this Patent; for instance they are known from the German Patent No. 655749, Swiss Patent No. 607245, Luxembourg Patent No. 80178 in various, but all rather similar versions and although they allow for assembly on the already connected cable by lateral thrust, they are inadequate because of their lack of stability on the cable.

To improve the stability of these "C" shaped sleeves on the cable, two internal flanges were recently provided (European Patent Nos. 0121454 and 0144675) along the edges of the sleeve opening, to improve the elastic adhesion and grip on the cable.

According to this invention, the stability of the "C" shaped supports is further increased because the sleeve edges are provided with two opposite shapes oscillating around A weaker zone when the cable is pushed-in and the shapes snap around the completely inserted cable. In particular conditions and expecially for marking of small sized cables, the same result can be achieved with "C" shaped sleeves, featuring only one end fitted with an oscillating shaping, whilst the other end is fixed and non oscillating.

This invention is illustrated in its practical and exemplifying implementation in the enclosed drawings, in which.

Figure 1:
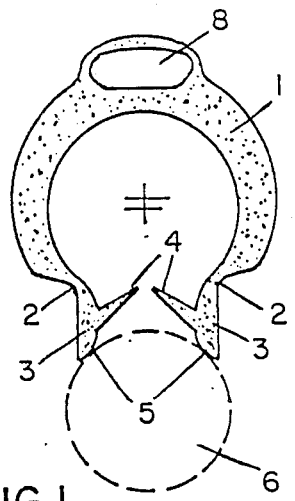
FIG. 1 shows a front view of the "C" shaped sleeve support, bearing ring shaped marking elements, introduced into a recess.
Figure 2:
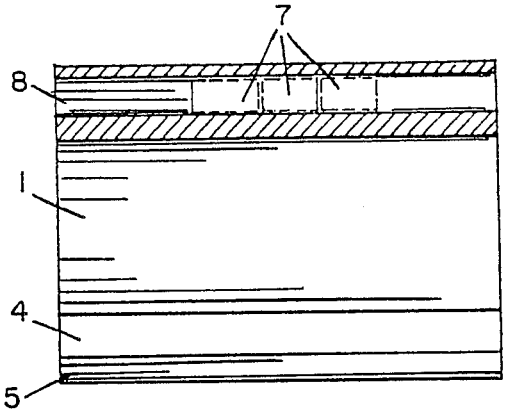
FIG. 2 shows the vertical central part of the support illustrated in FIG. 1.
Figure 3:
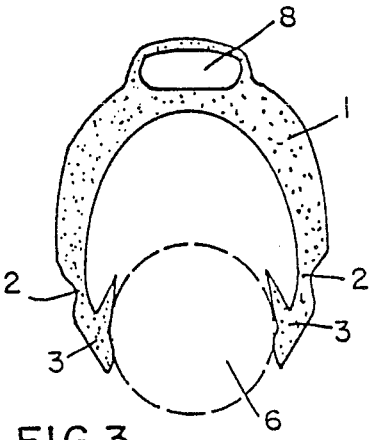
FIG. 3 shows the support of FIG. 1 during an intermediate assembly step on the cable.

With reference to the FIGS. 1 to 7 the open sleeve 1 is consisting of a body provided with two expansions slightly tapering towards the ends. Two opposite shapes 3, each consisting of an upper projection 4 having a thin triangular section and a convex lower projection 5 are connected through weakened zones 2 to these ends. These projections 4, 5 are directed inwards and the tips of the projections 4 are almost touching.

As normally happens during the assembly of "C" sleeves on the cables, the sleeve opening is applied to the cable 6 (FIG. 1) and the support is then elastically strained when pushed against the cable so that the cable can pass through the opening and, after installation, the support will snugly fit around the cable. In this case, during assembly, both shapes 3 rotate around the weakened zone 2 until they reach their intermediate position illustrated in FIG. 3 because of the action of the cable on the upper shapes.

Figure 4:
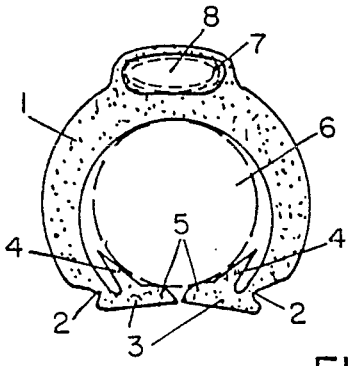
FIG. 4 shows the support of FIG. 1, completely mounted on the cable.

When the support 1 is further pressed against the cable 6, the elastic action of the support is applied to the lower semi-circumference of the cable 6, thus generating a "snap" action which automatically pushes the cable into the sleeve, while the shapes 3 exert a wrapping action on the cable 6 as shown in FIG. 4. This action is actually a snap action and you can hear its typical sound generated by the sudden final introduction.

The position of the support on the cable is therefore very stable, also favoured by the thrust and the wrapping action of the shapes 4, 5 against the lower part of the cable in contact with the internal central portion of the sleeve.

Figure 5:
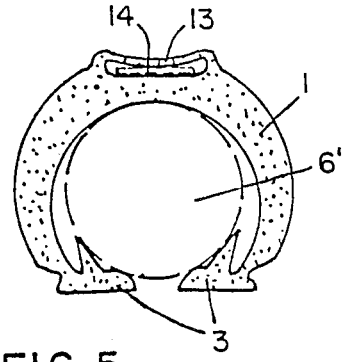
FIG. 5 shows the support of FIG. 1, completely mounted on a cable of different size.

As shown in FIG. 4 and 5, the same support may be used for different cable sizes 6, 6' within a rather large dimensional range.

Figure 6:
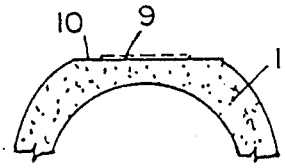
FIG. 6 and 7 show the support of FIG. 1 fitted, for exemplification purposes, with different marking systems.

The support covered by this invention may be fitted with any known marking system. FIG. 1 to 4 show an exemplifying marking system, consisting of sectional coded rings 7 to be introduced in a longitudinal recess 8 located on the outside of the support 1, while FIG. 6 shows a support with preprinted lettering 9 or attached to the flat surface 10.

Figure 7:
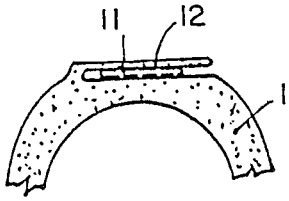

FIG. 7, features for exemplification, a marking system consisting of a label 11 protected by a covering 12. Special reference is made to the solution shown in FIG. 5 representing a new cable marking system. According to the latter solution, the upper wall 13 of the recess can be permanently modified internally, so as to hold a laminar element or a flat coded label in addition to normal coded rings.

Obviously, the solutions shown in FIG. 1 to 5 and in FIG. 7 require the utilization of transparent material for fabrication of the support, so as to ensure readibility of the lettering, but this does not exclude the utilization of two different plastic materials according to the solution of the German Patent No. 2831436 in which the sleeve is in opaque plastic material while the recess is transparent.

Usually, the support covered by this invention is obtained by extrusion and the product is then cut to suitable lengths. This extruded support may be in two materials, i.e. a body in opaque plastic material and the recess in transparent plastic, according to known techniques.

Obviously, the product covered by this invention may be obtained by injection molding; in this case, transparent plastic material shall be used so that the identification code can be easily read.

In particular conditions, especially for marking of small sized cables, the same result can be achieved with "C" shaped sleeves, featuring only one end fitted with an oscillating shaping. This single branch may either be shaped as specified in the FIGS. 1 to 7, but it may also be more enveloping up to the point of its overlapping the other non oscillating end of the C shaped sleeve.

With reference to the FIGS. 8 to 13, 15 refers to the C-shaped open sleeve support, the upper part of which has a recess 16 in which to introduce the marker elements or it may be provided with any other kind of marking system with codes or preprinted labels, according to various known solutions as above indicated.

According to this solution, only one end of the C shaped support is connected, along a weakened zone to an oscillating branch 18, whereas the other end 19 of the sleeve terminates with a non oscillating rounded tip which may be provided with a swelling 20, so that the sleeve can be fitted more easily on the cable.

Figure 9:
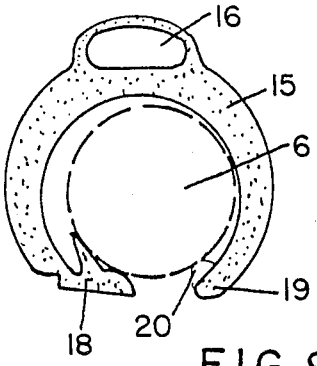
FIG. 9 shows the support of FIG. 8 mounted on a cable.

According to FIG. 1 and 9 this oscillating branch 18 is the same as adopted for both ends of the sleeve in the solution described in FIGS. 1 to 7, i.e. it is consisting of an upper prominence 4 having a thin triangular section and a lower crown 5 or swelling.

In this case too, elastic deformation of the support 1 occurs when pushing it sideways against the cable 6 so that the cable can slip through the opening in the sleeve and the branch 18 snaps back thus automatically and snugly fitting the cable in its support. The other free end 19 of the support will also elastically close around the cable as shown in FIG. 9.

Figure 8:
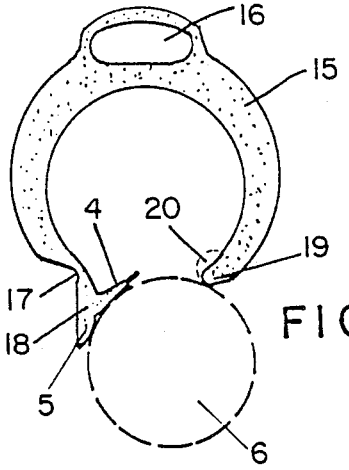
FIG. 8 shows a front view of the open sleeve support, only one end of which is fitted with an oscillating branch.
Figure 10:
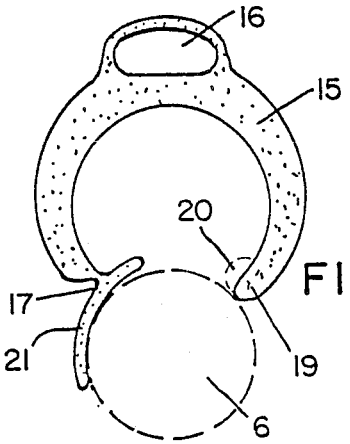
FIG. 10 shows a front view of the support with a more extensive oscillating branch.
Figure 11:
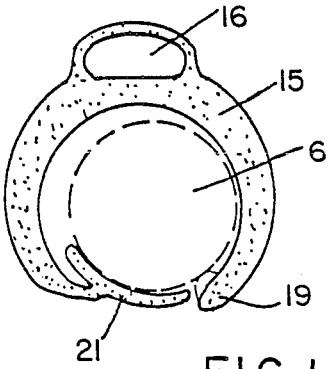
FIG. 11 shows the support illustrated in FIG. 10 mounted on the cable.

In FIG. 10 and 11 the oscillating branch 21 is consisting of an almost ring-shaped concavely curved section, which will virtually behave like the shaping 18 shown in FIG. 8 and 9.

Figure 12:
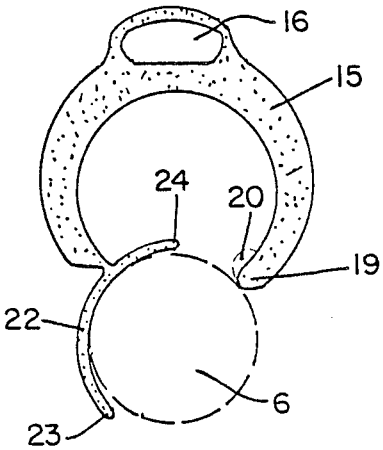
FIG. 12 shows a front view of the support with the oscillating branch extending until it covers the other end of the "C"-shaped sleeve.
Figure 13:
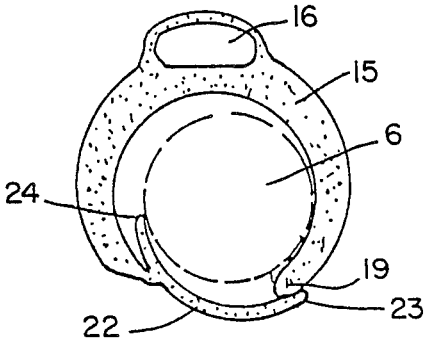
FIG. 13 shows the support illustrated in FIG. 12 mounted on a cable.

In FIG. 12 and 13 the oscillating concavely curved shaping 22 is greatly extended so that its free end 23 will overlap the other end 19 of the C-shaped sleeve after the cable has been mounted. The sleeve is thus completely closed while generating at the same time elastic strains within the oscillating branch 21, to be discharged on the cable through the internal end 24 and through the overlapping end 23 on the other branch 19 of the support to ensure better stability.

The oscillating branches 21 and 22 shown in FIG. 10 to 13 are featuring swellings or riflings to improve friction and for a better grip on the cable.

We claim:

1. A support for identifying electric wire or cable, which comprises:

(a) an elongated sleeve in the form of an open c having an internal central portion and opposed longitudinally extending free ends defining therebetween a longitudinally extending opening into said internal central portion, (b) at least one of said free ends of said sleeve being connected via a weakened zone to a longitudinally extending member operable to urge an electric wire or cable into said internal central portion of said sleeve, (c) said member having first and second portions projecting away from said weakened zone towards and away from said internal central portion of said sleeve, respectively, such that when said sleeve is mounted on a wire or cable by lateral pressure of the sleeve against the wire or cable, the sleeve will initially be subject to elastic deformation during its opening, while the member will oscillate around the weakened zone until it fits snugly around the wire or cable and, when the wire or cable is further pushed into the sleeve, elastic pressure of the member on the wire or cable will cause a snap action automatically pushing the cable into the sleeve and resulting in a renewed oscillation of the member around the weakened zone which will exert pressure on the wire or cable which rests inside the internal central portion of the sleeve.

2. The support according to claim 1, wherein only one of said free ends of said sleeve has a said member connected thereto.

3. The support according to claim 2, wherein the other of said free ends of said sleeve has a longitudinally extending crown-like swelling facing toward said internal central portion.

4. The support according to claim 2, wherein said first projecting portion is triangularly shaped and said second projecting portion is crown-shaped.

5. The support according to claim 2, wherein said member is concavely curved.

6. The support according to claim 5, wherein said first and second portions terminate in free ends, said second portion being sufficiently large such that said second portion free end will overlap said other free end of said sleeve when said wire or cable rests inside said internal central portion of said sleeve.

7. The support according to claim 5, wherein means is provided on said curved member to improve its grip on the wire or cable.

8. The support according to claim 1, wherein said sleeve has recess means for holding cable marking elements.

9. The support according to claim 8, wherein said recess means is holding ring-shaped marking elements.

10. The support according to claim 8, wherein said recess means has biasing means for holding flat labels.

11. The support according to claim 1, wherein both of said free ends of said sleeve has a said member connected thereto via a said weakened zone.

12. The support according to claim 11, wherein said first projecting portion of each said member is triangularly shaped and said second projecting portion of each said member is crown-shaped.

13. The support according to claim 12, wherein said first projections of said members are almost touching.

* * * * *